US005645002A

United States Patent [19]

Brocklehurst

[11] Patent Number: 5,645,002

[45] Date of Patent: Jul. 8, 1997

[54] EDGE HEMMER WITH CORNER CONTROLLER

[75] Inventor: Charles E. Brocklehurst, Fountain Inn, S.C.

[73] Assignee: Sew Simple Systems, Inc., Fountain Inn, S.C.

[21] Appl. No.: 619,010

[22] Filed: Mar. 21, 1996

[51] Int. Cl.[6] ..... D05B 21/00; D05B 37/04; D05B 1/20

[52] U.S. Cl. ..... 112/470.07; 112/141; 112/309; 112/475.04

[58] Field of Search ..... 112/470.07, 470.05, 112/470.06, 470.03, 470.09, 475.03, 475.04, 475.05, 475.06, 475.21, 475.26, 308, 309, 320, 147, 148, 153, 141, 143

[56] References Cited

U.S. PATENT DOCUMENTS

| | | | |
|---|---|---|---|
| 3,722,441 | 3/1973 | Kitchner et al. | 112/309 |
| 3,970,017 | 7/1976 | Babson et al. | 112/121.12 |
| 4,181,085 | 1/1980 | Conner, Jr. | 112/121.12 |
| 4,362,115 | 12/1982 | Rose et al. | 112/121.12 |
| 4,434,730 | 3/1984 | Rose et al. | 112/121.12 |
| 4,601,249 | 7/1986 | Frye | 112/121.11 |
| 4,608,936 | 9/1986 | Ball et al. | 112/121.12 |
| 4,685,408 | 8/1987 | Frye | 112/262.3 |
| 4,688,499 | 8/1987 | Moore et al. | 112/121.12 |
| 4,722,290 | 2/1988 | Manuel et al. | 112/153 |
| 4,776,579 | 10/1988 | Romand et al. | 112/121.12 |
| 5,018,462 | 5/1991 | Brocklehurst | 112/121.12 |
| 5,396,854 | 3/1995 | Noqueras | 112/309 X |
| 5,529,004 | 6/1996 | Porter et al. | 112/470.07 X |
| 5,560,308 | 10/1996 | Eto | 112/470.06 |

*Primary Examiner*—Peter Nerbun
*Attorney, Agent, or Firm*—Thomas, Kayden, Horstmeyer & Risley

[57] ABSTRACT

Corner controller (62) (FIG. 5) includes a conically shaped corner control wheel (90) that is rotated so as to apply a sweeping motion against the facing surface of the textile segment (12). This results in removing any folds or wrinkles from the textile segment as it moves to the sewing station (64). The corner control wheel is up the sewing path, ahead of the turning axis (111) of the textile segment. Therefore, when the textile segment is turned by the turning plate (45) through 90° to form a curved corner about the textile segment (FIG. 6), the corner control wheel (90) urges the corner to move through its turning motion, so as to avoid nonuniform turning of the corner and any wrinkling of the corner material, and therefore avoiding the doubling up or bunching of the stitches formed about the rounded corner of the final textile segment.

13 Claims, 6 Drawing Sheets

EDGE HEMMER WITH CORNER CONTROLLER

FIELD OF THE INVENTION

This invention relates to a method and apparatus for forming wash cloths and other segments of flexible sheet material from a continuous supply of the sheet material, such as terry cloth, and forming hems, such as an over-edge stitch, about the edges of the segments of material. More particularly, the invention relates to a system for accurately guiding and transporting cut segments of material through a sewing machine, and turning the segments about a radius as their corners reach the sewing station so as to continuously trim and hem all of the edges of the segments and to form rounded corners in the segments.

BACKGROUND OF THE INVENTION

In the manufacture of terry cloth wash cloths and towels and other flat textile goods, the material usually is formed and accumulated in an elongated length of cloth material which is wound into a supply roll. The roll of supply material is positioned at a sewing system and is progressively unwound and advanced toward the sewing system, where it is cut into segments. Each segment is then moved individually along a sewing path into a sewing machine and turned at its corners so that the sewing machine continuously operates to sew about all sides of the segment and to form rounded corners between adjacent sides of the segment. An example of this type of system is disclosed in U.S. Pat. No. 5,018,462.

Although the prior art hemming devices operate successfully when forming hems on substantially rectilinear edges, problems still exist with respect to the successful forming of hems about rectangular wash cloths and other approximately rectangular segments of flexible textile fabrics. This is illustrated in FIG. 11 of the drawings. When the sewing machine is in operation and is trimming and hemming along a side edge of a rectangular segment 12 and a corner 22 of a segment approaches the sewing machine, the segment is turned approximately 90° so that the next edge of the segment can be trimmed and hemmed. The corner is usually turned through a radius as opposed to through a right angle so that the corner of the finished product is rounded during the trimming and sewing operation. During this turning procedure, an additional amount of material 22 is cut from the corner of the segment in comparison with the amount cut from the side edge of the segment and the position of the cutter is further from the perimeter of the corner of the segment. In most instances, the enlarged amount of material 22 in the portion of the corner that is being cut away is more difficult to control during the trimming, sewing and turning operation, and this bulk material in the cut away corner tends to bend or fold at 71 and retard the movement of the segment through the trimmer and the sewing needle. As a result, the sewing machine tends to form double or crowded stitches at the rounded corners of the slower moving product as shown at 125 in FIG. 12. In addition, the corners with crowded stitches tend to curl after the sewing operation due to the additional stitches formed therein, and in many instances the loops of the additional stitches will protrude outwardly from the edge of the segment, so that the stitches form a small fringe protruding from the rounded corners of the segment.

In an effort to avoid the above described problems, it is possible to move the transport plate that controls the movements of the segment closer to the position of the edge trimmer and the sewing needle so that the length of the textile segment which extends between the transport plate and the trimmer is so short that the likelihood of folding, bending or flexing of the textile segment at the trimmer and needle is substantially reduced.

While the placement of the transport plate closer to the trimmer and sewing machine needle helps to solve the aforementioned problems, the relocation of the transport plate closer to the trimmer and sewing machine needle reduces the ability of the transport plate to handle off-sized goods. For example, if the system is to function to cut and hem thirteen inch wash cloths, the segments being fed to the sewing station must be at least 13½" wide and long. If the textile fabric being fed to the system is somewhat stretched and has become less than 13½" wide, the transport plate normally would be moved closer to the trimmer blade and sewing machine needle to compensate for the narrowed supply material; however, if the transport plate has already been moved close to the trimmer and sewing machine needle to compensate for the wrinkling of the work product, there is no space available to move the transport plate even closer to the trimmer and needle to compensate for the narrowed supply of material.

Therefore, there is a need for a hemming system that can accurately control the trimming and sewing about the corners of textile segments, and also function to operate on off-sized goods.

SUMMARY OF THE INVENTION

Briefly described, the present invention comprises an improved system for forming wash cloths and other segments of flexible textile fabric, by cutting the textile fabric in segments and forming an overedge stitch hem about the edges of the segments, while rounding off the corners of the segments.

The sheet material is fed from a supply roll through a cutting station where the sheet material is cut to length, and a transport plate moves downwardly into contact with the segment and transports the segment across a flat work surface to a sewing station.

An edge of the textile segment is moved by the transport plate into alignment with the path of the sewing machine, and the transport plate advances the aligned edge through the sewing path, through the trimmer and sewing needle, to trim away a small portion of the edge of the textile segment and to form an overedge 504 stitch about the trimmed edge.

As the trailing corner of the textile segment approaches the sewing station, the transport plate rotates the textile segment about an upright axis so that the trimmer forms a rounded edge at the corner until the next straight edge of the segment becomes aligned in the sewing path. In the meantime, the sewing machine continues its highspeed operation so as to form the overedge stitch continuously about the rounded corner and then along the next oncoming edge of the textile segment.

In order to assure that the corner structure of the textile segment does not become wrinkled and to make sure that additional bunched stitches are not formed in the rounded corner structure, a corner control wheel is positioned up the sewing path from the sewing needle and is placed in engagement with the textile segment and is rotated to lightly urge the textile segment across the sewing path. This light urging force tends to lightly stretch the expanse of the textile fabric extending between the transport plate and the sewing path so as to remove any wrinkles that might be present in the textile segment, therefore making sure that the hem formed in the textile segment is straight. Further, the corner control wheel is shaped so that it does not interfere with the oncoming leading edge of a freshly cut segment being presented to the sewing station or the oncoming leading edge of a label that has been placed on the edge of the textile segment.

The corner control wheel is placed in contact with the edge portion of the textile segment that is moving along the sewing path toward the sewing station, and the wheel continuously rotates. The rotary movement of the corner control wheel tends to "walk" the wheel on the surface of the textile segment, without noticeably retarding the movement of the textile segment along the sewing path. Since the corner control wheel is displaced back up the sewing path from the sewing needle, the corner control wheel usually engages the portion of the corner of the textile segment that is to be removed from the textile segment as the textile segment is turned. When the transport plate begins to turn the textile segment, the corner control wheel gains control of the right angle corner and urges the corner of the textile segment through its arcuate path so that there is no bunching or wrinkling of the textile material that is being removed.

As the textile segment is being turned, the right angle corner which is being cut from the segment to form the rounded corner is urged laterally by the corner control wheel, in a direction across the sewing path at a position up the sewing path from the axis of rotation of the segment, therefore applying a turning motion to the segment to assist the corner to move through the turn. This tends to avoid any wrinkling or folding or bunching of the right angle corner of the segment which is being removed from the finished product.

The foregoing system avoids the inconsistent movement of the corner of the textile segment as it is being trimmed and hemmed, and thereby avoiding the bunching of stitches on the rounded corner and avoiding the formation of loops which protrude from the rounded corner on the finished product.

Thus, it is an object of this invention to provide an improved method and apparatus for forming a supply of textile fabric into segments, and then trimming and hemming the edges of the textile segments, while forming rounded corners about the segment.

It is another object of this invention to provide an improved system for cutting and hemming about the edges of approximately rectangular segments of flexible textile fabric.

Another object of this invention is to provide an improved system for feeding sheet material to a cutting station, cutting across the sheet material to form segments of the sheet material, and then treating the edges of the sheet material.

Another object of this invention is to provide a sewing machine attachment for accurately and reliably controlling the corner of a rectangular segment of flexible textile fabric as the segment is being turned at the sewing station to form a rounded corner in the segment.

Other objects, features and advantages of this invention will become apparent upon reading the following specifications, when taken in conjunction with the accompanying drawings.

DETAILED DESCRIPTION

Figure 1:
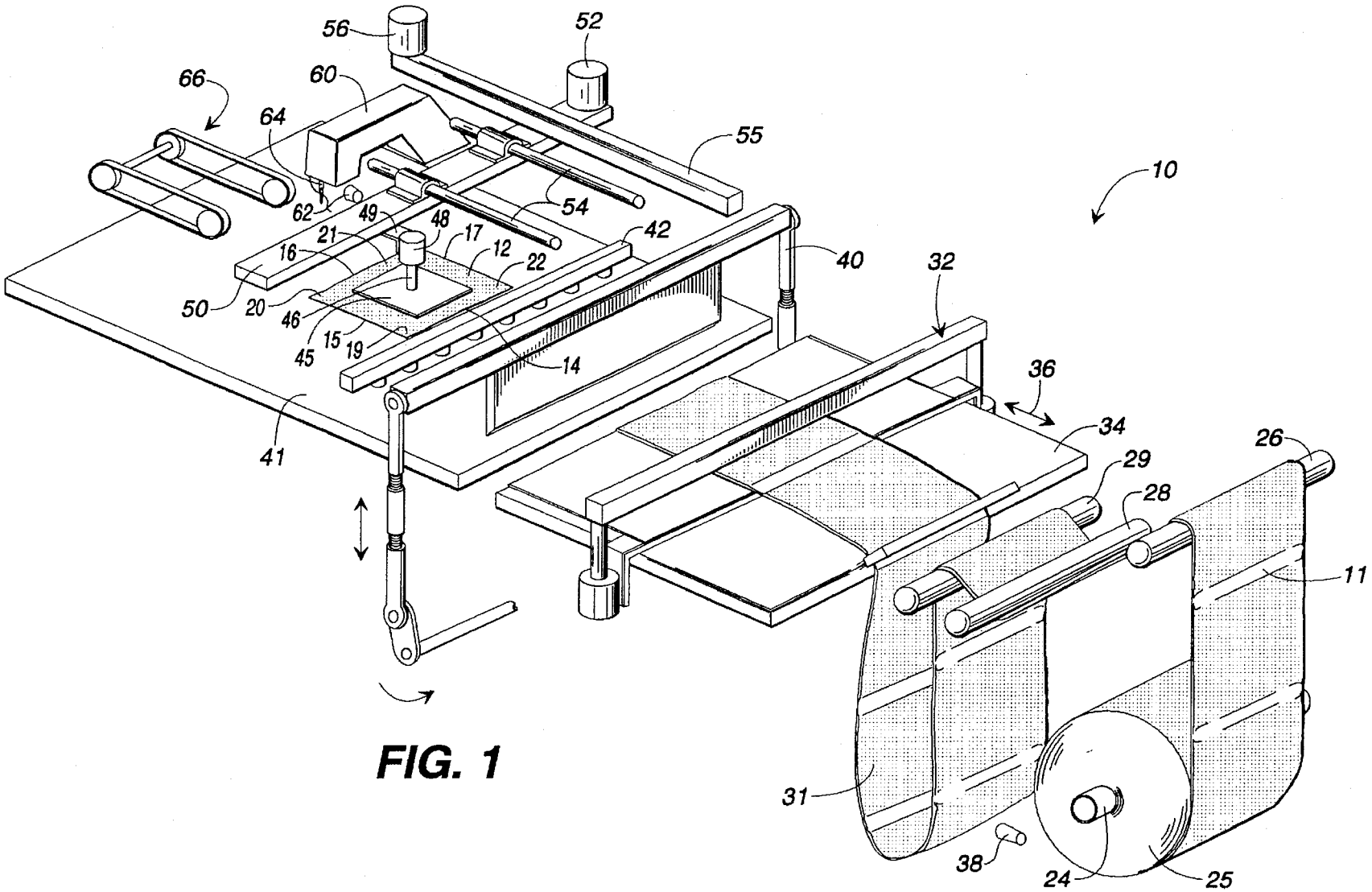
FIG. 1 is a perspective schematic illustration of an edge finishing apparatus for paying out a flexible textile fabric, cutting it into segments, edge hemming the segments and stacking the segments.

Referring now in more detail to the drawings in which like numerals indicate like parts throughout the several views, FIG. 1 illustrates the edge finishing apparatus 10 for cutting and finishing the sheet material 11 to form a finished work product such as wash cloth, towels and other segments of flexible textile fabrics 12, each of which has adjacent edges intersecting one another and which form corners about the segment. For example, the wash cloth 12 has adjacent edges 14, 15, 16 and 17, and corners 19, 20, 21 and 22 formed at the intersections of the edges.

The edge finishing apparatus 10 includes a support 24 for a roll of spirally wound textile sheet material 25, such as terry cloth, and guide rolls 26, 28 and 29 which pay out the sheet material into an accumulation loop 31. A table clamp 33 is mounted to work table 34, and work table 34 is movable in response to an air operated cylinder (not shown) positioned beneath the table in the directions as indicated by the double-headed arrow 36. When the table clamp moves downwardly, it engages the textile material that is extended across the movable work table, and the work table is then indexed along the sewing path to carry the leading edge of the textile material to the next work station.

In the meantime, a photocell 38 determines the length of the accumulation loop 31 in the material and when more material is needed, it actuates one of the guide rolls 26, 28 or 29 to rotate and pull the textile material into the accumulation loop.

Cutter assembly 40 is arranged at the end of movable work table 34, between movable work table 34 and stationary work table 41, and is arranged to cut the textile material with a downward stroke between the tables.

Draw out bar 42 is movable downwardly and into engagement with the leading end of the supply of textile material, and then moves along the feed direction to draw out the textile material beneath the cutter assembly. When the material has been drawn out to the predetermined distance, the table clamp moves downwardly to engage the trailing portion of the supply of material, and then the cutter assembly 40 cycles downwardly to cut a segment of the material away from the supply. After the cut has been made and the segment has been formed, the movable work table 34 is indexed in the direction of feed so as to extend the leading portion of the supply of textile material beyond the cutter assembly, where it is positioned for the next cycle of the cutting system.

Transport plate 45 is positioned over the stationary work table 41, and is movable in response to a transport plate control means in X and Y directions for transporting the wash cloth about the stationary work table, is movable up and down, away from and toward the wash cloth 12 so as to engage and release the wash cloth from its control, and is rotatable about an upright axis so as to turn the wash cloth on the stationary work table.

The transport plate control means includes a computer and program, and the elements responsive thereto for moving the transport plate.

More specifically, the transport plate 45 is supported over the work table 41 in a plane parallel to the surface of the work table by an upright stem 46, and stem 46 is rotatably supported by reversible rotary motor 48. Motor 48 is mounted to a support arm 49, and the support arm can be raised and lowered by a pneumatic cylinder (not shown) to lower and raise the transport plate toward and out of engagement with the work table. Support arm 49 is movably mounted to a cross arm 50 and is movable along the length of the cross arm by means of a conveyor belt (not shown) in the cross arm. The conveyor belt is driven by rotary motor 52, so as to carry the transport plate 45, its stem 46, rotary motor 48 and support arm 49 back and forth across the direction of feed of the textile material. Cross arm 50 is slidably supported on a pair of parallel travel rods 54.

The cross arm is movably mounted to longitudinal arm 55 and is movable along the length of longitudinal arm 55 by means of a conveyor belt (not shown) in the longitudinal arm, with the conveyor belt being movable in response to the operation of reversible rotary motor 56. Thus, the transport plate 45 is movable longitudinally with respect to the direction of feed of the textile material across the stationary work table 41.

Sewing machine 60 is mounted at the edge of the stationary work table 41, and corner controller 62 is mounted up the sewing path from the needle 64 of the sewing machine. The position of the needle 64 is the sewing station of the system.

A stacking conveyor 66 is mounted at the end of the stationary work table 41 for engaging and moving the wash cloths 12 off the work table and into a stack positioned at a lower level than the surface of the work table.

Figure 2:
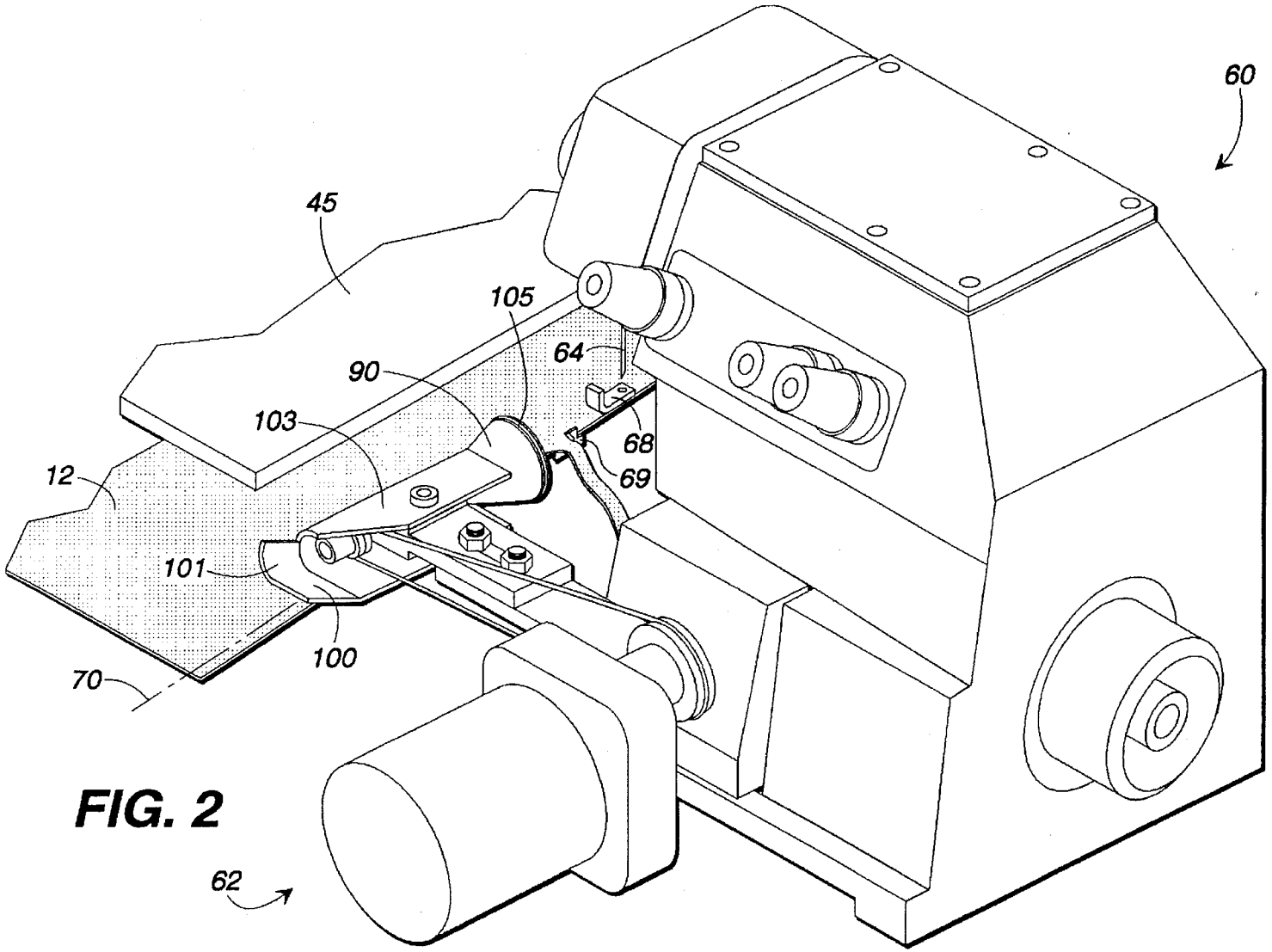
FIG. 2 is a perspective illustration of a sewing machine, a corner controller and a portion of a transport plate which are used to control, trim and hem a segment of flexible textile fabric.

As illustrated in FIG. 2, the sewing machine 60 is of standard design and includes the sewing needle 64, presser foot 68 and edge trimmer 69. A sewing path 70 extends from the needle 64, in alignment with the presser foot and feed dogs (not shown) of the sewing machine. The feed dogs pull the wash cloth 12 through the sewing station in the conventional manner.

Transport plate 45 also controls the movement of the washcloth 12 during the trimming and sewing operation performed by the sewing machine 60.

Figure 4:
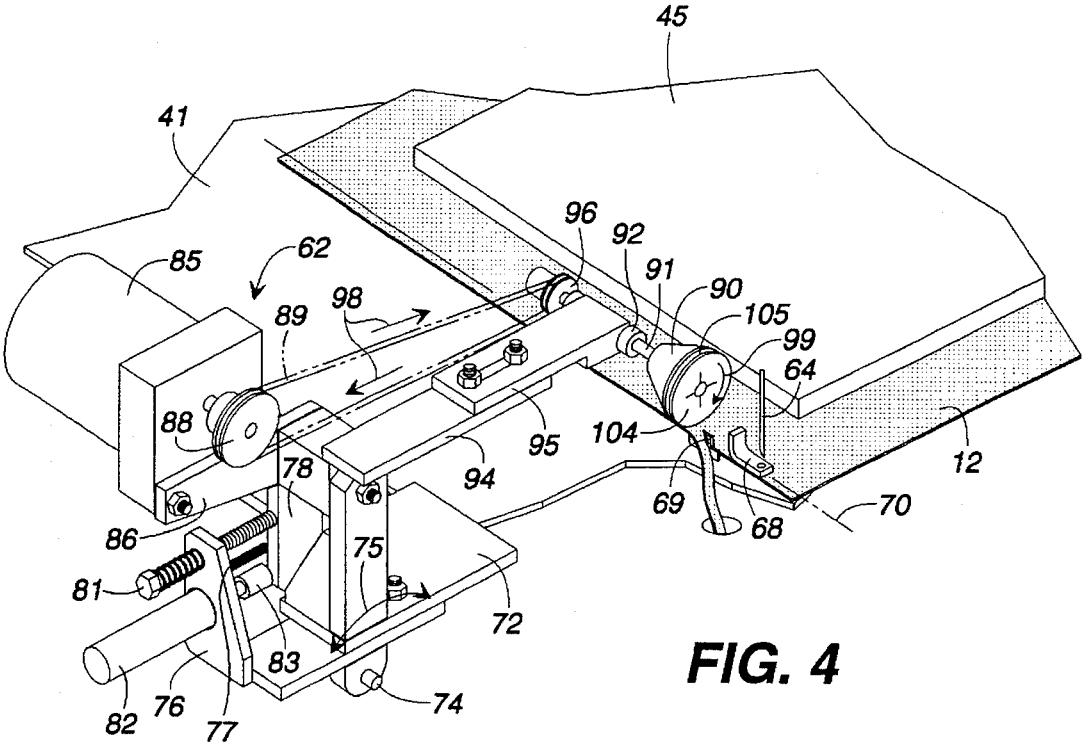
FIG. 4 is a perspective illustration of the corner controller, transport plate and the textile segment, showing the details of construction of the corner controller.

As illustrated in FIG. 4, the corner controller includes a tiltable support plate 72 that is pivotally mounted to pivot pin 74 so that the corner controller can tilt in an arc as indicated by the double-headed curved arrow 75. Vertical mount 76 is attached to and movable with tiltable support plate 72. A stationary frame element 70 extends downwardly from the frame of the work table (not shown) to a position spaced from the vertical mount 76 of the tiltable support plate 72, and coil tension spring 80 is connected between the stationary frame element 78 and the vertical mount 76 of the tiltable support plate 72, causing the tiltable support plate to tilt in a downward arc toward the work table. Adjustable set screw 81 extends through vertical mount 76 and abuts stationary frame element 78, so as to adjustably limit the pivoting of the tiltable support plate 72 toward the work table 41.

Pneumatic cylinder 82 is also mounted to the vertical mount 76 of tiltable support plate 72 and its plunger 83 engages stationary frame element 78. When the plunger 83 is distended from cylinder 82, the tiltable support plate 72 tilts upwardly away from the work table 41.

Corner controller 62 includes electric motor 85 which is mounted by support arm 86 to the tiltable support plate 72. Sheave 88 is rotated by motor 85 and drive belt 89 is driven by the sheave. Conically shaped corner control wheel 90 is mounted on axle 91, and axle 91 is rotatably supported in bearing 92. The bearing is supported at the end of adjustable length arms 94 and 95. Sheave 96 is mounted on the distal end of axle 91, and the drive belt 89 extends about and rotates the sheave. The motor 85 always operates the drive belt 89 in the directions as indicated by arrows 98. This causes the corner control wheel 90 to rotate in the direction as indicted by arrow 99, so that the lower surface of the corner control wheel 90 moves away from the transport plate 45.

Figure 8:
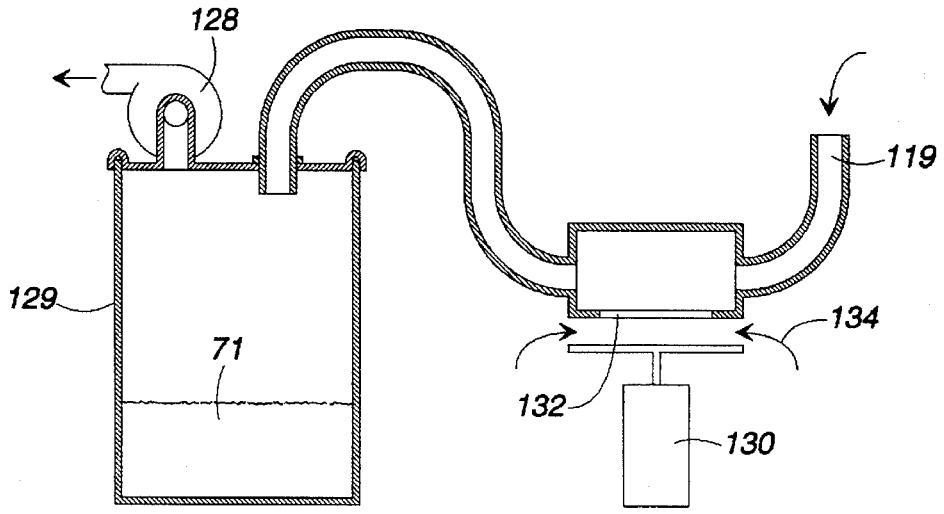
FIG. 8 is a schematic illustration of the vacuum system which removes the cutaway portion of the textile segment from the vicinity of the sewing station.

From the above noted description of the structure, it can be seen that when the pneumatic cylinder 82 retracts its plunger 83, the coil tension spring 77 tilts the corner controller 62 toward the work table, so that the corner control wheel 90 moves down into engagement with the wash cloth 12 or other flexible textile segment which is present on the work table 41 beneath the transport plate 45. The adjustable set screw 81 limits the downward arc of movement of the corner control wheel 90, so that the set screw can be adjusted to adjust the downward force applied by the corner control wheel to the textile segment. Usually the force to be applied by the corner control wheel to the textile segment is a lateral brushing of the segment, as illustrated in FIG. 8. When the pneumatic cylinder 82 distends its plunger 83, the corner control wheel 90 is tilted upwardly away from and out of contact with wash cloth 12.

Figure 3:
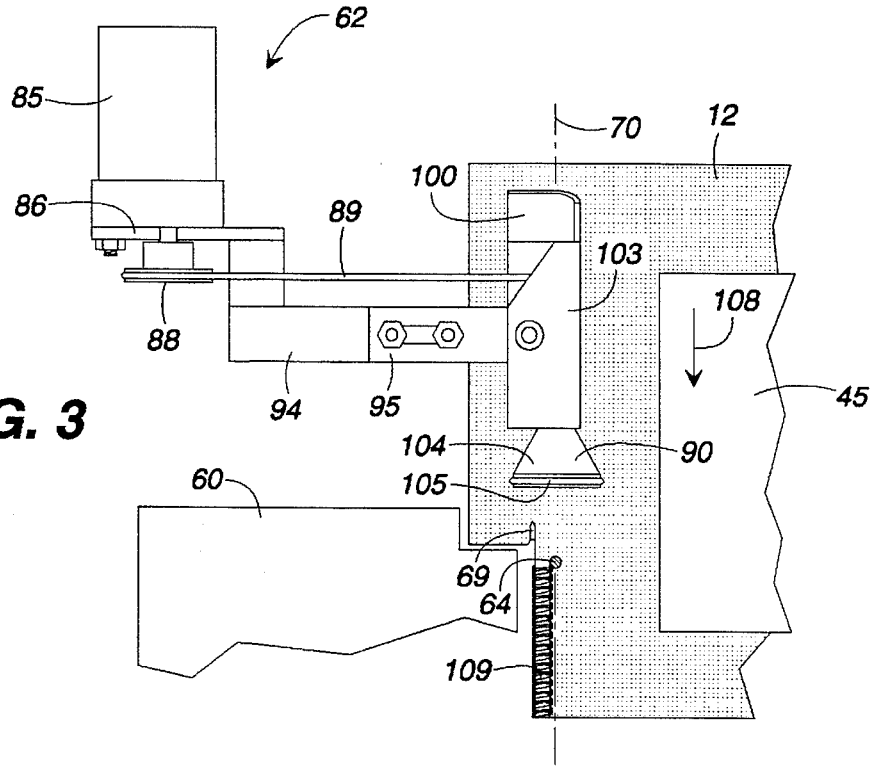
FIG. 3 is a plan view of the corner controller, a portion of the sewing machine, and a portion of the transport plate, as they are being used to form the edge of the textile segment.

As illustrated in FIGS. 2 and 3, guide fender 100 is mounted to adjustable length arm 95. Guide fender 100 includes an upwardly turned guide portion 101 that is tilted upwardly in the direction that faces the oncoming wash cloth as the wash cloth moves along the sewing path 70. The slope of the fender 101 causes the leading edge of the wash cloth to be deflected downwardly and not flip back over or wrinkle as it moves beneath the corner controller 62 and toward the sewing station 64. The guide fender includes a curved portion 103 that extends about the bearing and axle of the corner controller.

Corner control wheel 90 is conically shaped, and includes a large diameter end 104 that protrudes from the guide ski 100 and faces down the sewing path toward the sewing station 64 and a small diameter portion that extends up the sewing path inside the guide fender 100. An elastic band 105 is seated in an annular groove (not shown) at the large diameter end 104 of the corner control wheel 90. The band 105 protrudes from the larger diameter end of the corner control wheel 90 and engages the nap of the wash cloth 12.

OPERATION

As illustrated in FIG. 3, the transport plate 45 is moved downwardly into engagement with the wash cloth 12 or other segment of textile material, and the transport plate moves in the direction as indicated by arrow 108 to carry a first edge of the textile segment on through the sewing station 64. As the textile segment initially moves through the sewing station, the corner controller 62 is tilted up by its cylinder 82 and cutter 69 trims a portion of the edge of the segment away from the larger body portion of the segment, and the needle at sewing station 64 forms a 504 overedge stitch 109 about the trimmed edge of the segment.

Figure 5:
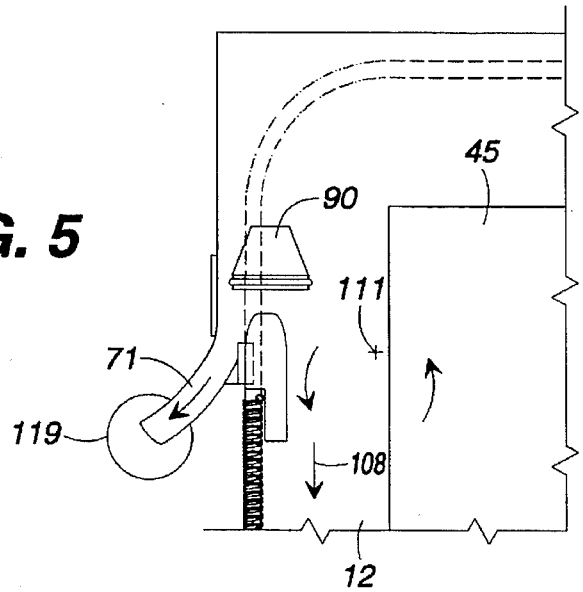
FIG. 5 is a plan view of a portion of a textile segment as a hem is being formed along one edge of the segment and the segment is about to be turned for forming the rounded edge of the segment.

As illustrated in FIG. 5, when the textile segment 12 has advanced far enough so that the corner 22 and the adjacent edge 14 approach the sewing station 64, the cylinder 82 retracts its plunger and coil tension spring 80 tilts the corner controller down into engagement with the moving textile segment and the transport plate 45 begins the turn of the segment about a turning axis 111. The corner controller remains in its down position in constant engagement with the segment for the rest of the trimming and sewing operation about all sides of the segment. Turning axis 111 is displaced inwardly of the intersecting edges of the corner of the textile segment.

Figure 6:
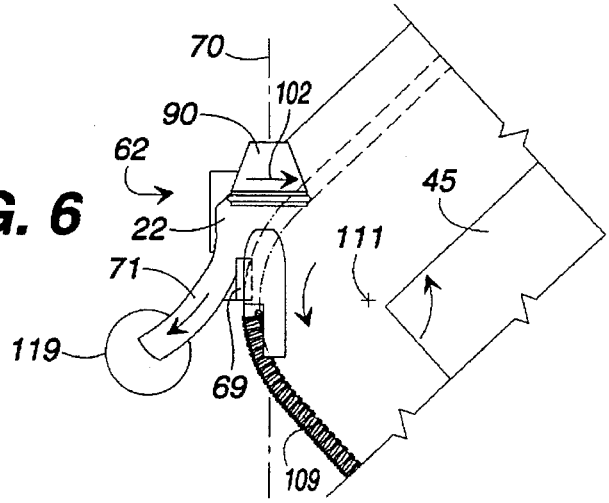
FIG. 6 is a plan view of the textile segment, similar to FIG. 5, but showing the textile segment as it is being turned to form the rounded corner of the segment.
Figure 7:
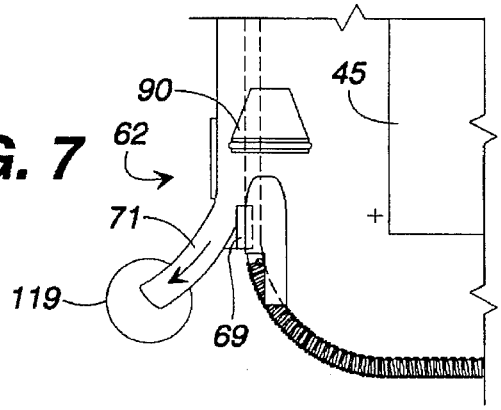
FIG. 7 is a plan view of the textile segment similar to FIGS. 5 and 6 but showing the textile segment after it has been turned and as the next edge is being finished.

As illustrated in FIG. 6 where the transport plate 45 has turned the segment approximately one-half way through a 90° turn, it will be noted that the corner control wheel 90 still engages the corner 22 of the textile segment 12 and continues to rotate so that it sweeps against the adjacent surface of the textile segment in the direction as indicated by arrow 102. As the textile segment 12 continues to move through its 90° turn, the next adjacent straight edge moves into alignment with the sewing path 70 (FIG. 7) and the turning of the segment is stopped while the movement of the segment along the sewing path is resumed. In the meantime, the corner control wheel has never left sweeping engagement with respect to the textile segment, so that it continues to sweep in a lateral direction generally away from the transport plate 45. Thus, it can be seen that any wrinkles that might have been present in the textile segment 12 between the sewing station 64 and the transport plate 45 would have been gently urged out of and removed from the textile segment prior to the textile segment having been trimmed and hemmed. However, during the turning of the textile segment by the transport plate, the sweeping action of the corner control wheel 90 against the textile segment at a contact area up the sewing path from both the sewing station 64 and the turning axis 111 assists in turning the corner of the segment.

Figure 10:
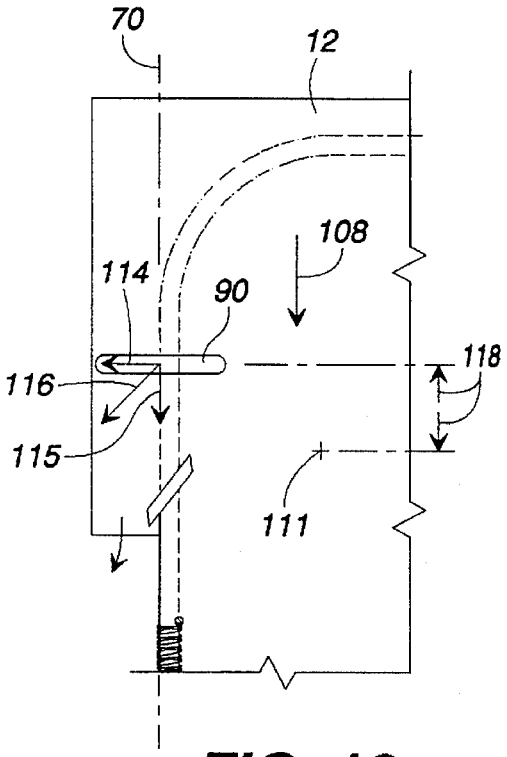
FIG. 10 is a vector diagram showing the movement of the wheel of the corner controller and the movement of the textile segment through the sewing station when the corner of the segment approaches the sewing station, at the position approximately as shown in FIG. 5.

As illustrated in FIG. 10, when the textile segment 12 is moving along its rectilinear path 108 under the influence of the transport plate 45 and the feed dogs of the sewing machine (not shown), the corner control wheel 90 applies the sweeping motion to the textile segment 12 at position 113. The vector 114 of the motion applied by the corner control wheel 90 sweeping against the adjacent surface of the textile segment 12 extends laterally of the sewing path 70, away from the transport plate 45, while the vector 115 that represents the movement of the textile segment 12 as controlled by the transport plate extends in the direction of the sewing path. Therefore, the resulting vector 116 of the corner control wheel felt by the textile segment 12 extends approximately between the vectors 114 and 115. The position 113, where the corner control wheel 90 sweeps against the facing surface of the textile segment is offset longitudinally from the turning axis 111 as indicated by arrows 118. This offset of position of the corner control wheel 90 from the turning axis 111 results in the corner control wheel applying a turning motion about the turning axis once the turning motion of the textile segment is begun by the transport plate 45. Therefore, the corner control wheel assists in turning the large bulky corner material of the textile segment, so that this larger portion of the material that is being cut away does not impede the turning movement of the textile segment.

Figure 11:
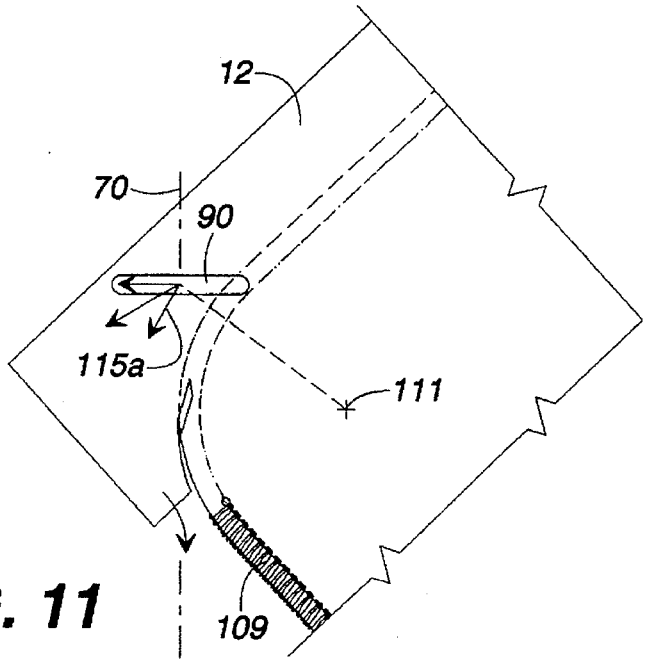
FIG. 11 is a vector diagram, similar to FIG. 9, but showing the vectors as the textile segment is being turned, in a position similar to that illustrated in FIG. 6.

As illustrated in FIG. 11, once the transport plate begins to turn the textile segment 12, the movement of the textile segment is no longer linear along the sewing path 70 but extends at an arc around the turning axis 111 as indicated by vector 115*a*. Therefore, the sweeping motion applied to the textile segment 12 by the corner control wheel more vigorously urges the textile segment to rotate about turning axis 111.

Figure 9:
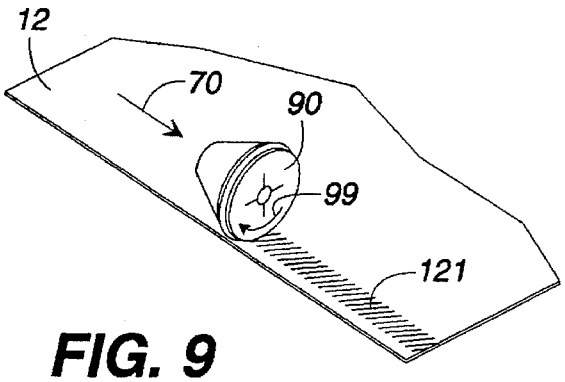
FIG. 9 is a perspective schematic illustration of a textile segment and the wheel of the corner controller illustrating the lateral brushing contact that the corner controller applies to the textile segment.

As illustrated in FIG. 9, when the corner control wheel 90 rotates as indicated by the direction arrow 99 and sweeps against the facing surface of the textile segment 12, and as the textile segment 12 moves along the sewing path 70, the contact made between the corner control wheel 90 and the textile segment 12 is represented by the diagonal lines 121 of FIG. 9. Because the contact of the corner control wheel 90 is a lateral sweeping movement against the textile segment 12, the corner control wheel offers very little resistance to the movement of the textile segment 12 along the sewing path 70, so that no wrinkles will be formed in the textile segment by the corner control wheel 90. However, the lateral sweeping movement of the corner control wheel 90 tends to gently stretch the textile segment 12 away from the transport plate, thereby removing wrinkles from the segment.

Figure 12:
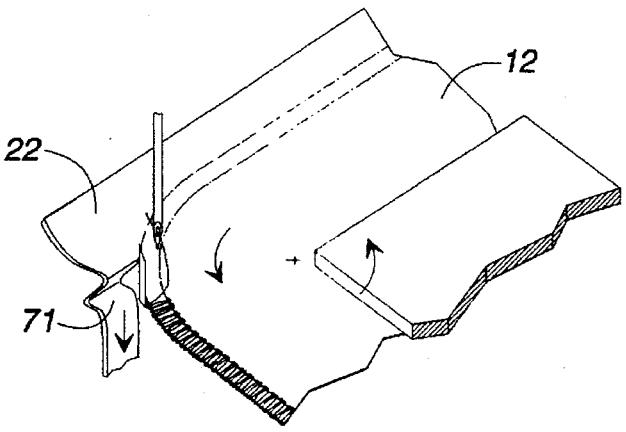
FIG. 12 (PRIOR ART)
FIG. 12 is a plan view of the problems encountered in a prior art system, showing the textile segment as it is being turned to form its rounded corner.
Figure 13:
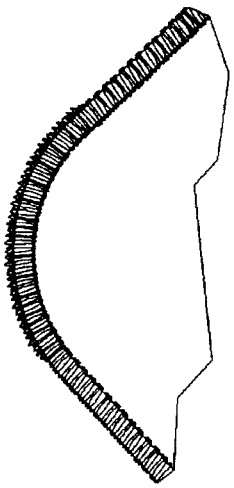
FIG. 13 (PRIOR ART)
FIG. 13 is a detail illustration of a textile segment that has been formed by a prior art system, illustrating a problem that is solved by the present invention.

The system described above avoids the bunching or wrinkling of the cutaway portion 71 of the textile segment 12 as illustrated in FIG. 12. The bunching or wrinkling in the cutaway portion typically retards the turning motion of the corner, causing the sewing machine to form overlapping or bunched stitches as shown at 125 in FIG. 13 that protrude from the edge of the work product, forming a small fringe at the rounded corner of the work product.

The positive sweeping engagement by the corner control wheel 90 against the textile segment, as schematically illustrated in FIG. 9, and as applied to the corner of the textile segment, FIG. 6, avoids the folding or bunching of the cutaway portion 71 and of the adjacent corner material of the segment.

As illustrated in FIG. 6, the trimmed portion 71 of the textile segment is guided into a vacuum conduit 119. During the cycle of trimming and hemming, no air flow is induced through the vacuum conduit 119, so that no irregular tugging or pulling of the cutaway portion 71 of the textile segment will be applied. The uncontrolled tugging or pulling might result in accelerating or decelerating the movement of the textile segment during the trimming and sewing process, thereby forming an irregular product. However, once the trimming and sewing functions have been completed, a stream of air is drawn into the vacuum conduit 19 to remove the trimmed away portion 71 from the vicinity of the sewing station.

As shown in FIG. 8, an air compressor 128 is mounted to the lid of a large container 129 and pulls a stream of air into the container. The container is in communication with the vacuum conduit 119, so that a stream of air is pulled into the container, thereby inducing the trimmed away portion 71 to move into the large container 129, accumulating in the bottom of the container.

A valve assembly 130 opens a large bypass opening 132 in the vacuum conduit 119, allowing ambient air to move into the large container 129 as indicated by arrows 134. This results in terminating most of the flow of air through the portion of the conduit 119 extending to the sewing station. Once the sewing machine terminates its operation, the valve 130 closes the bypass opening 132 so as to establish the stream of air flowing through the conduit 119 from the sewing station, thereby removing the cutaway portions of the segments from the vicinity of the sewing machine.

It will be understood that the foregoing relates only to a preferred embodiment of the present invention, and it is anticipated that numerous changes and modifications may be made therein without departing from the spirit and scope of the invention as set forth in the following claims.

I claim:

1. A process of hemming about the edges of an approximately rectangular segment of flexible textile fabric having adjacent edges intersecting one another and forming corners about the segment comprising:

advancing a first edge of the segment along a sewing path and into a sewing station with the first edge of the segment oriented substantially parallel to the sewing path;

cutting away a portion of said first edge of the segment as the first edge approaches the sewing station;

forming a hem stitch in the first edge of the segment as the first edge passes through the sewing station;

as the corner of the segment between the first and second adjacent edges approaches the sewing station, continuing the cutting and forming of a hem stitch while turning the segment about an axis of rotation displaced inwardly of the segment from the intersecting first and second adjacent edges until the corner moves through a turn and is cut away from the segment and the second edge is oriented substantially parallel to the sewing path;

advancing the second edge along the sewing path and into the sewing station while continuing the step of cutting away a portion of the edge as the edge moves through the sewing station and continuing the step of forming a hem stitch in the edge;

as the segment is turned, urging the corner of the segment adjacent the intersection of the first edge with the second edge at a position up the sewing path from the sewing station in a direction across the sewing path to assist in moving the corner through the turn.

2. The process of claim 1 and wherein the steps of advancing and turning the segment comprise engaging the segment with a transport plate and moving the segment with the transport plate across a substantially flat work surface.

3. The process of claim 2 and further including the steps of feeding the textile fabric from a supply and cutting the supply into rectangular segments.

4. The process of claim 1 and wherein the step of urging the corner of the segment in a direction across the sewing path comprises engaging the corner of the segment approaching the sewing station with a wheel member and rotating the wheel member in a direction to urge the corner of the segment through the turn.

5. The process of claim 4 and wherein said wheel member is approximately conically shaped with a large diameter end and a small diameter end, and wherein the step of engaging the corner of the segment with a wheel member comprises engaging the corner of the segment with the large diameter end of the wheel member with the small diameter end directed up the sewing path.

6. The process of claim 1 and wherein the step of urging the corner of the segment in a direction across the sewing path comprises brushing the corner of the segment approaching the sewing station with a rotating wheel member having an axis of rotation approximately parallel to the sewing path.

7. The process of hemming about the edges of an approximately rectangular segment of flexible textile fabric having adjacent edges intersecting one another at corners about the segment comprising:

advancing one edge of the segment along a sewing path and into a sewing station with the edge oriented substantially parallel to the sewing path;

forming a hem stitch in the edge of the segment at the sewing station;

as the corner of the segment between the edge in the sewing path and the following edge approaches the sewing station, turning the segment to move the corner of the segment through the sewing path until the following edge becomes oriented substantially parallel to the sewing path;

as the segment is being turned, urging the corner of the segment at a position up the sewing path from the sewing station in a direction across the sewing path to assist the corner to move through the turn; and repeating the process until the edges of the segment have been hemmed.

8. The process of claim 7 and wherein the step of urging the corner through the turn comprises engaging the corner with a wheel member and rotating the wheel member in a direction to urge the corner of the segment across the sewing path.

9. The process of claim 7 and further including the step of trimming the edges of the segment as each edge approaches the sewing station, and after the step of trimming the edges of the segment has been completed, urging the portion trimmed from the segment with a stream of air away from the segment.

10. The process of forming an approximately rectangular segment of flexible textile fabric having adjacent edges intersecting one another comprising:

advancing a length of textile material toward a sewing station;

cutting the length of textile material into approximately rectangular segments having adjacent edges intersecting one another at corners about the segment;

advancing an edge of each segment along a sewing path and into a sewing station with the edge oriented substantially parallel to the sewing path;

forming a hem stitch in the edge of each segment at the sewing station;

as the corner of each segment between the edge in the sewing path and the following edge approaches the sewing station, turning the segment to move the corner of the segment through an arcuate sewing path until the following edge becomes oriented substantially parallel to the sewing path and the corner of the segment joining the adjacent edges has been cut away;

as the segment is being turned, urging the corner of the segment at a position up the sewing path from the sewing station in a direction across the sewing path to assist the corner to move through the arcuate turn; and repeating the process until the edges of the segment have been hemmed.

11. Apparatus for hemming about the edges of approximately rectangular segments of flexible textile fabric having edges intersecting one another at corners about the segment comprising:

a substantially flat horizontal work surface;

a sewing station positioned at said work surface and defining a sewing path through said sewing station for sewing about the edges of said segments;

a transport plate movable about said work surface for urging a segment of material across said work surface and along the sewing path and through said sewing station;

transport plate control means for moving said transport plate and a segment engaged by said transport plate about said work surface and for rotating said transport plate and said segment with respect to said sewing station for forming a hem about the edges and corners of a segment;

corner control means positioned to engage said segment up the sewing path from the sewing station for urging the segment across the sewing path as a corner of the segment moves into said sewing station.

12. Apparatus for hemming about the edges of approximately rectangular segments of flexible textile fabric having edges intersecting one another at corners about the segment comprising;

a work surface;

a sewing station positioned at said work surface and defining a sewing path through said sewing station for sewing about the edges of said segments;

transport means for urging a segment of material across said work surface and along the sewing path and through said sewing station;

control means for moving said transport means and a segment engaged by said transport means with respect to said sewing station for forming a hem about the edges and corners of a segment;

corner control means positioned to engage said segment up the sewing path from the sewing station for urging the segment across the sewing path as a corner of the segment moves into said sewing station.

13. The apparatus of claim 12 and wherein said corner control means comprises wheel means, and means for suspending said wheel means, above said work surface at a height to brush against said segments, and means for rotating said wheel means in a direction to brush across the segment as the segment is urged along said sewing path.

* * * * *